United States Patent [19]

Tsuzuki

[11] Patent Number: 4,589,660

[45] Date of Patent: May 20, 1986

[54] MINIATURE ACTION TOY

[75] Inventor: Akio Tsuzuki, Tokyo, Japan

[73] Assignee: Tomy Kogyo, Co. Inc., Tokyo, Japan

[21] Appl. No.: 745,313

[22] Filed: Jun. 14, 1985

[51] Int. Cl.[4] ..... A63F 9/14

[52] U.S. Cl. ..... 273/1 GA; 446/26

[58] Field of Search ..... 446/26, 28, 7; 273/1 GA, 1 GC, 1 GE, 86 F, 86 G

[56] References Cited

U.S. PATENT DOCUMENTS 4,270,306 6/1981 Klawitter ..... 273/1 GA X 4,438,922 3/1984 Suda ..... 273/1 GA

FOREIGN PATENT DOCUMENTS 545262 1/1956 Italy ..... 273/1 GA

*Primary Examiner*—Mickey Yu

*Attorney, Agent, or Firm*—K. H. Boswell

[57] ABSTRACT

A miniature action toy suitable for strapping to the wrist of the user includes a windup motor having a control pawl and ratchet wheel. An indicia carrier strip is located on two spools which are driven by an output gear of the motor. A first control element is positioned over the indicia strip so as to move laterally side to side over the indicia strip, and up and down toward and away from the indicia strip. A second control element is positioned so as to contact the first control element and further includes a pawl locking element which is positioned so as to contact the motor pawl. In response to upward movement of the first control element away from the indicia strip, the pawl locking element locks with the motor pawl so as to freeze the motor. In response to movement of the first control element down toward the indicia strip, the pawl locking element disengages from the pawl so as to free the motor and allow the output gear to roll the spools and the indicia strip attached thereto.

7 Claims, 7 Drawing Figures

MINIATURE ACTION TOY

BACKGROUND OF INVENTION

This invention is directed to a miniature action toy having a windup motor which includes a control pawl and a ratchet wheel. A series of control elements, ultimately moved by the user of the toy, includes a pawl locking element which can engage with and lock the motor pawl so as to stop output of the motor.

A spectrum of activity toys is known. These include very large toys such as arcade type housings, table models, and even hand held action toys. Some of these incorporate moving film strip, disks, or the like, which produce action or movement within the toy.

By their nature and complexity, toys which include moving film strips or the like have heretofore been fairly substantial in size with the smallest being a lap held toy. This is because of the complex control mechanisms needed to produce and control the movement of the strip, disk, or the like.

With the advent of integrated circuits, it has been possible to produce electronic toys which are very small. However, in order to have a toy having a fairly sophisticated output, the electronic toys have generally been fairly expensive, and as such, not suitable for small children.

BRIEF DESCRIPTION OF THE INVENTION

In view of the above, it is evident that there exists a need for new and improved toys which are miniature in size, yet are of a mechanical nature so as to be economically produced and available to the consumer. It is therefore a broad object of this invention to provide such a toy. It is a further object of this invention to provide a toy which does not require any consumable parts such as batteries or the like. In the illustrative embodiment of the invention it is an object to provide a toy which is capable of being attached to the forearm of the user of the toy, thus, serve not only as an action toy but also as decorative ornament for the user of the toy.

These and other objects, as will be evident from the remainder of this specification, are achieved in a miniature action toy which comprises: a housing; a windup motor located in said housing, said motor having an output gear, said motor including a control pawl and a ratchet wheel, said control pawl pivotally mounted in association with said ratchet wheel so as to engage and disengage with said ratchet wheel in response to pivoting of said pawl to control said motor; a first and second spool located in said housing in operative association with said output gear so as to be rotated by said output gear; an indicia carrier strip operatively attached to each of said first and said second spools, said indicia carrier strip winding from one of said first and said second spools to the other of said first and said second spools in response to rotation of said spools by said output gear; said indicia carrier strip located in said housing in a position such that a continuously changing portion of said indicia carrier strip is visible to the operator of said toy as said indicia carrier strip winds from one of said spools to the other of said spools; a first control element positioned in association with said indicia carrier strip, said first control element slideably mounted on said housing so as to slide under the influence of the operator of said toy laterally side to side across the indicia carrier strip and further up and down away from and towards said indicia carrier strip; a second control element positioned in association with said first control element and said control pawl, said second control element pivotally mounted on said housing, said second control element including a pawl locking element; biasing means associated with said second control element, said biasing means biasing said second control element against said first control element to move said first control element away from said indicia strip and to engage said pawl locking element against said pawl to lock said pawl, said pawl in turn locking said motor and said output gear; said first control element, in moving toward said indicia carrier strip, moving said second control element against the bias of said biasing means and disengaging said pawl locking element from said pawl to unlock said motor whereby said output gear rotates said spools.

In the illustrative embodiment of the invention, the housing of the toy is sized and shaped so as to fit against the forearm of the user of the toy, and further includes wrist straps allowing the toy to be temporarily connected to the forearm of the user of the toy.

BRIEF DESCRIPTION OF THE DRAWINGS

This invention will be better understood when taken in conjunction with the drawings wherein.

This invention utilizes certain principles and/or concepts as are set forth in the claims appended to this specification. Those skilled in the toy arts will realize that these principles and/or concepts are capable of being utilized in a variety of embodiments which may differ from the exact embodiment utilized for illustrative purposes herein. For this reason this invention is not to be construed as being limited solely to the illustrative embodiment, but should only be construed in view of the claims.

DETAILED DESCRIPTION OF THE INVENTION

Figure 1:
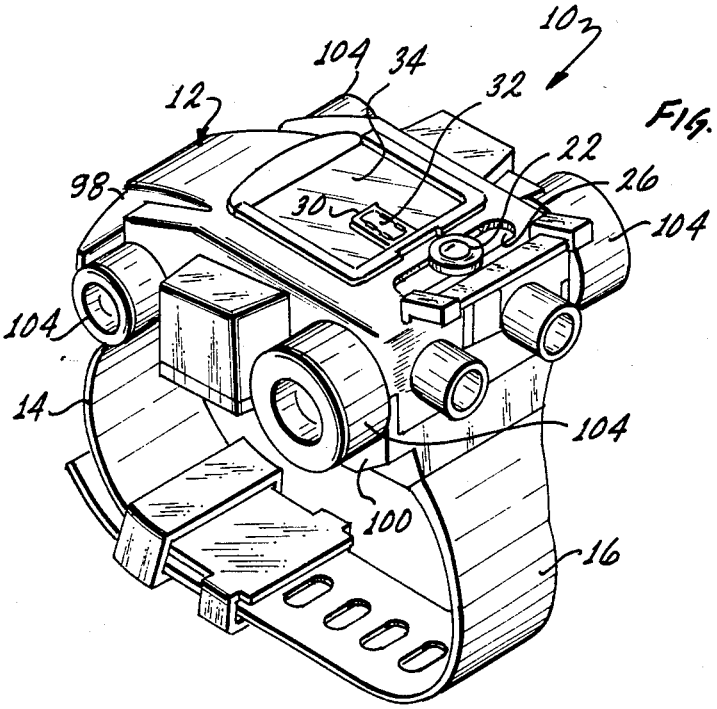
FIG. 1 is an isometric view of an illustrative embodiment of this invention.
Figure 3:
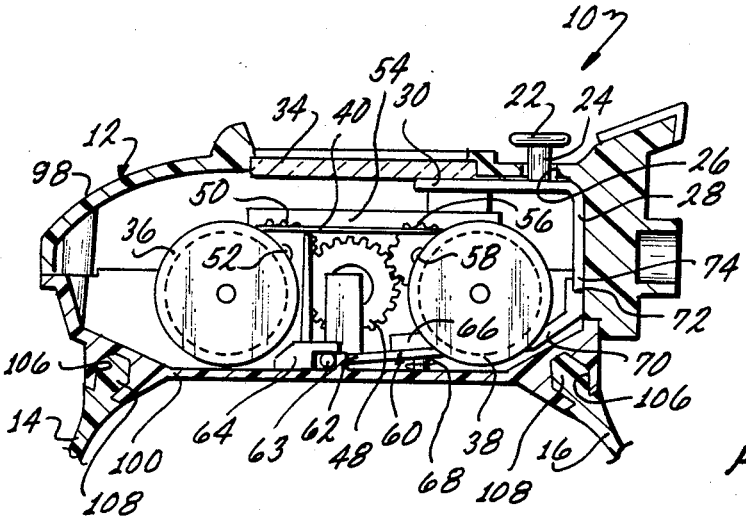
FIG. 3 is a side elevational view about the line 3—3 of FIG. 2.

In FIG. 1 there is shown a miniature action game 10. It has a main housing 12 and two wrist straps 14 and 16 respectively. The main housing 12 is sized and shaped so as to fit onto the top of the forearm and is held there by the straps 14 and 16 which engage and connect to one another.

Figure 2:
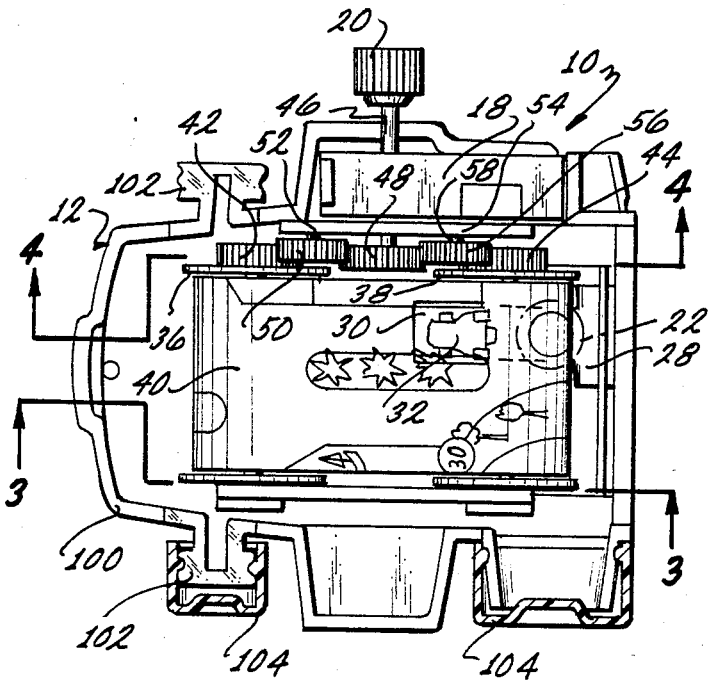
FIG. 2 is a top plan view of the toy of FIG. 1 with certain overlying components removed for clarity of underlying components.

To utilize the miniature action game 10, the operator of the same winds a small motor 18, located in the interior of the toy, by turning an external knob 20 which is seen in FIG. 2. Without doing anything further, the motor 18 stays in an energized state and the toy 10 produces no output.

There is a small wheel 22 which is connected to a shaft 24 which is free to move laterally back and forth to the left and right in a slot 26 located on the top of the housing 12. The shaft 24 connects to a first control element 28 located beneath the upper portion of the housing 12. A display arm 30 formed as part of control element 28 extends beneath the upper portion of the housing 12 and includes a small indicia 32 located on its end. The indicia 32 is directly located beneath a transparent window 34 formed in the top of the main housing 12.

The operator moves the wheel 22 laterally side to side, left and right, and this in turn moves the first control element 28 which results in movement of the indicia 32 laterally left and right beneath the window 34. If the operator depresses the wheel 22 downwardly into the interior of the housing 12, and if the motor 18 is in an energized state, then other mechanisms are activated to produce movement of a scene beneath the window 34.

Located within the interior of the housing 12 is a front spool 36 and a rear spool 38. An indicia carrier strip 40, which is elongated, is attached at each of its ends to one of the spools 36 and 38. As seen in FIG. 2, attached to the spool 36 is a pinion 42 and, likewise, attached to the spool 38 is a pinion 44. The knob 20 attaches to a motor shaft 46 which extends through the motor 18. Also attached to the motor shaft 46 on the opposite side of the motor 18, from the knob 20, is an output gear 48. The output gear 48 rotates in conjunction with rotation of the shaft 46 and the knob 20.

A pinion gear 50 is journalled via an axle 52 to a plate member 54. A similar pinion 56 is journalled to an axle 58 also attached to the plate member 54. The plate member 54 is located within the housing 12 between the motor 18 and the spools 36 and 38. This positions the pinions 50 and 56 such that they both mesh with the output gear 48. Also pinion 50 meshes with pinion 42 and pinion 56 meshes with pinion 44 such that rotation of the gear 48 is transferred to the pinions 42 and 44 and, in turn, to the spools 36 and 38.

When the motor 18 is energized, or wound up, by rotating the knob 20, this motion is communicated via the shaft 46 to the gear 48. Because the gears 50 and 56 are positioned in the gear train leading from gear 48 to gears 42 and 44, the gears 42 and 44 rotate in the same direction as does the gear 48. Upon winding, or energizing, of the motor 18 by rotation of the knob 20, motion is communicated to the spools 36 and 38 to transfer any portion of the indicia strip 40, wound on the spool 38, to the forward spool 36.

Figure 4:
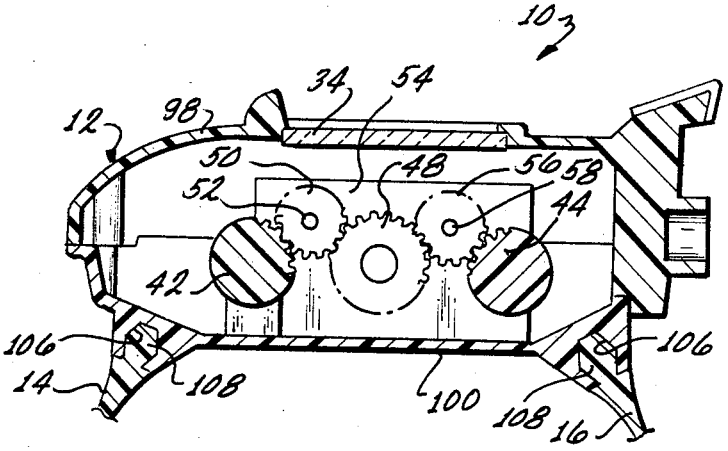
FIG. 4 is a side elevational view about the line 4—4 of FIG. 2.
Figure 5:
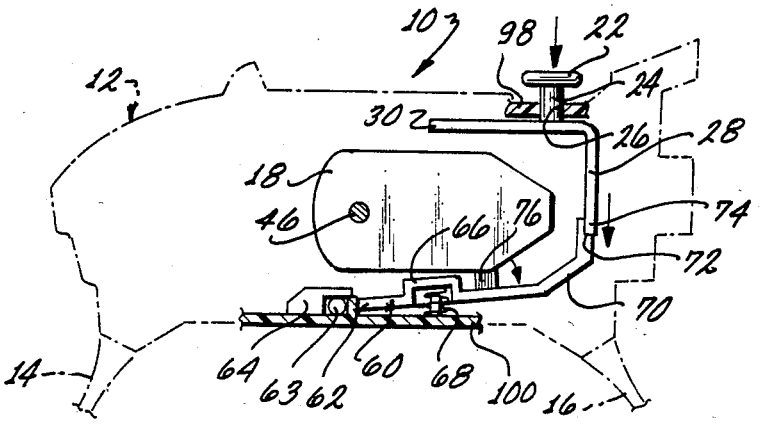
FIG. 5 is a fragmentary side elevational view of parts behind those of FIG. 4.
Figure 6:
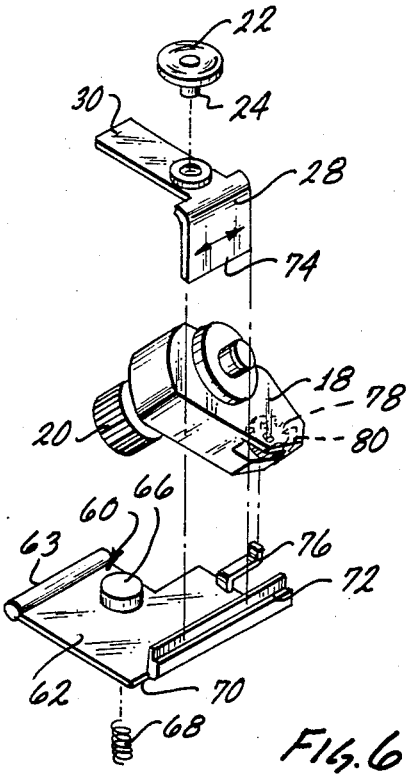
FIG. 6 is a fragmentary exploded view of certain of the components seen in FIG. 5.

The wheel 22, in addition to being able to move laterally side to side, also is capable of moving up and down away from and toward the indicia strip 40. When the wheel 22 is positioned distal from the indicia strip 40, the motor 18, as hereinafter explained, is locked irrespective of whether or not it is in an energized or unenergized state. However, when the wheel 22 is pushed downward into the housing 12 toward the indicia strip 40, the motor 18, if energized, rotates the shaft 46 and, in doing so, rotates the gear 48. This causes rotation of the gear 48 clockwise as seen in FIG. 4 such that the indicia strip 40 is wound off of the front spool 36 and wound onto the rear spool 38.

During winding of the strip 40 from the spool 36 to the spool 38, a constantly changing portion of it is exposed through the window 34. The indicia strip 40 carries a continuous scene thereon such that the scene viewable to the user of the toy 10 through the window 34 is continually changing. As the indicia strip 40 moves beneath the window 34, the user of the toy 10 manipulates the wheel 22 side to side so as to avoid overlaying of the indicia 32 on the display arm 30 with any of the scene or pattern moving below it on the indicia strip 40. The indicia strip 40 will maintain movement beneath the window 34 as long as the user of the toy maintains the depression of wheel 22 until the motor 18 becomes "unwound", that is it becomes de-energized.

The first control element 28 includes a contact arm 60 which is formed at a right angle with the display arm 30. The contact arm 60 is positioned behind the rear spool 38 and extends downwardly within the interior of the housing 12. A second control element 62 is located on top of the bottom surface of the main housing 12. It has a small cylindrical portion 63 which fits beneath an L shaped tab 64 formed as a portion of the bottom surface of the housing 12. This positions the control element 62 in a fixed position within the main housing 12, but allows it to pivot with a limited rotation about the cylindrical portion 63. The control element 62 includes a hollow boss 66 formed thereon which opens to the bottom of the control element 62. A compression spring 68 fits within this boss and is captured between it and the bottom of the housing 12. The compression spring 68 biases the end 70 of the control element 62 upwardly.

The end 70 of the control element 62 is formed as a contact member which engages the contact arm 60 of the first control element 28. The end 70 includes an elongated shoulder 72 which serves as a receiving surface for the end 74 of the arm 60. The end 74 of the arm 60 is free to slide along the shoulder 72. However, any downward motion of the arm 60 is communicated to the second control arm 62, and any upward motion of the control arm 62 is communicated to the arm 60. The compression spring 68 biases both the control element 62 and the control element 28 upwardly such that, under the bias of the spring 68, the wheel 22 is pushed upwardly.

The control element 62 includes a pawl locking arm 76 formed thereon. It is positioned beneath the motor 18. The motor 18 includes a ratchet wheel 78 and a pawl 80 as a portion of its internal mechanism. These serve as an escapement mechanism to govern the output speed of the motor 18, but they also serve as an input point to lock the motor 18 such that it won't unwind even if it is in an energized state.

When the operator of the toy 10 releases the knob 20, the bias in the spring 68 pushes the second control element 62 upwardly which, in turn, pushes the first control element 28 upwardly. Simultaneously the pawl locking arm 76 abuts against the pawl 80 such that it is no longer capable of pivoting and locks against the ratchet wheel 78. This freezes the motor 18 against further rotational output of its output gear 48.

When the wheel 22 is depressed, the downward motion is communicated to the element 28 which, in turn, communicates the motion to the element 62 depressing the pawl locking arm 76 away from the motor 18 to release it from the pawl 80, allowing the pawl 80 to then pivot such that the escapement mechanism composed of the pawl 80 and the ratchet wheel 78, functions and the motor 18 can unwind to rotate the spools 36 and 38 respectively. Because of the presence of the elongated shoulder 72, the first control element 28 can engage the second control element 62 irrespective of its lateral movement side to side on the housing 12. Thus, during operation of the toy, the user of the same, by depressing the wheel 22, can cause movement of the indicia strip 40 simultaneously with movement of the indicia 32 across the indicia strip 40.

Figure 7:
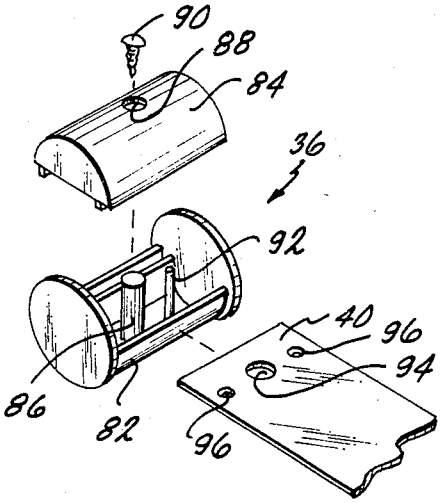
FIG. 7 is a fragmentary exploded view of other components of the toy.

In FIG. 7, the attachment of the indicia strip 40 to the spool 36 is shown. The spool 36 is formed of two parts, a main portion 82 and a cap portion 84. The main portion 82 has a hollow boss 86 which fits through an opening 88 formed in the cap portion 84. A screw 90 connects the cap portion 84 to the main portion 82. To the left and right of the boss 86 are identical bosses, only one which is shown, boss 92. The indicia strip 40 has three holes, a central hole 94, and two smaller holes collectively identified by the numeral 96. The hole 94 fits over the boss 86 with the holes 96 fitting over the boss 92 and the unseen boss which is identical to it. The cap portion 84 is then secured to the main portion 82 locking the indicia strip 40 to the spool 36. The spool 38 is formed identically to the spool 36, and the indicia strip 40 is attached to it in the identical manner.

The housing 12 is formed of an upper piece 98 and a lower piece 100. These pieces are formed so as to mate together and each include four mating hemispherical extensions which form axle projections, collectively identified by the numeral 102, for wheels, collectively identified by the numeral 104. The wheels 104 friction fit over the axle projections 102. The wheels 104 are formed as hollow cylindrical elements open on one end. The axle projections 102 are formed of the two separate hemispherical sections and when the wheels 104 are pushed over the axle projections 102, this holds the two hemispherical sections of the axle projections 102 together, which, in turn, locks the upper piece 98 and the lower piece 100 of the housing 12 together.

The lower piece 100 of the housing 12 has undercut grooves, collectively identified by the numeral 106, formed on its bottom portion both in the front and the rear of the housing 12. These grooves receive tongues, collectively identified by the numeral 108, formed on the straps 14 and 16 respectively. This allows the straps 14 and 16 to be conveniently attached to the housing 12 by simply sliding the tongues 108 within the grooves 106. The use of these connectors, as well as the cylindrical wheels 104, snapping over the axle projections 102, allows the toy 10 to be conveniently assembled and held together. In view of this, there are no external screws or the like to entice the child to disassemble the toy 10.

I claim:

1. A miniature action toy which comprises:

a housing;

a windup motor located in said housing, said motor having an output gear, said motor including a control pawl and a ratchet wheel, said control pawl pivotally mounted in association with said ratchet wheel so as to engage and disengage with said ratchet wheel in response to pivoting of said pawl to control said motor;

a first and second spool located in said housing in operative association with said output gear so as to be rotated by said output gear;

an indicia carrier strip operatively attached to each of said first and said second spools, said indicia carrier strip winding from one of said first and said second spools to the other of said first and said second spools in response to rotation of said spools by said output gear;

said indicia carrier strip located in said housing in a position such that a continuously changing portion of said indicia carrier strip is visible to the operator of said toy as said indicia carrier strip winds from one of said spools to the other of said spools;

a first control element positioned in association with said indicia carrier strip, said first control element slideably mounted on said housing so as to slide under the influence of the operator of said toy laterally side to side across the indicia carrier strip and further up and down away from and towards said indicia carrier strip;

a second control element positioned in operative association with said first control element and said control pawl, said second control element pivotally mounted on said housing, said second control element including a pawl locking element;

biasing means associated with said second control element, said biasing means biasing said second control element against said first control element to move said first control element away from said indicia strip and to engage said pawl locking element against said pawl to lock said pawl, said pawl in turn locking said motor and said output gear;

said first control element, in moving toward said indicia carrier strip, moving said second control element against the bias of said biasing means and disengaging said pawl locking element from said pawl to unlock said motor whereby said output gear rotates said spools.

2. The miniature action toy of claim 1 wherein:

said housing is sized and shaped so as to fit against the forearm of said operator of said toy;

said toy further including strap means connected to said housing, said strap means for holding said housing on said forearm of said operator.

3. The miniature action toy of claim 1 incuding:

connecting means, a portion of said connecting means located on said first control element and a further portion of said connecting means located on said second control element, said connecting means for transferring movement between said first and said second control elements.

4. The miniature action toy of claim 3 wherein:

said connecting means includes a contact arm located on said first control element and positioned on said first control element so as to extend toward said second control element;

said connecting means further including a contact member formed as a portion of said second control element and located on said second control element in a position extending toward said contact arm on said first control element;

said contact arm contacting said contact member so as to transfer motion between said first and said second control elements.

5. The miniature action toy of claim 4 wherein:

said contact arm slideably connecting with said contact member so as to move on said contact member by sliding on said contact member.

6. The miniature action toy of claim 4 wherein:

said contact member includes an elongated shoulder located thereon;

said contact arm engaging said elongated shoulder and sliding along said elongated shoulder in response to lateral movement of said first control element side to side across said indicia carrier strip.

7. The miniature action toy of claim 1 wherein:

said first control element includes a display arm and a contact arm, said display arm and said contact arm joined together at about a 90° angle, said display arm positioned over said indicia carrier strip, said contact arm positioned adjacent to one of said first or said second spools and extending toward said second control element so as to contact said second control element.

* * * * *